US009090108B2

(12) United States Patent
Nakajima et al.

(10) Patent No.: US 9,090,108 B2
(45) Date of Patent: Jul. 28, 2015

(54) TAPE PRINTING APPARATUS WITH SET POSITION REGULATION SECTION

(71) Applicant: Seiko Epson Corporation, Tokyo (JP)

(72) Inventors: Kenichi Nakajima, Shimosuwa-machi (JP); Akihiro Shintani, Masumoto (JP); Nobuyuki Horii, Kawasaki (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 13/840,610

(22) Filed: Mar. 15, 2013

(65) Prior Publication Data

US 2013/0259557 A1 Oct. 3, 2013

(30) Foreign Application Priority Data

Mar. 29, 2012 (JP) ..... 2012-076452

(51) Int. Cl.

| | |
|---|---|
| ***B41J 3/36*** | (2006.01) |
| ***B41J 15/04*** | (2006.01) |
| ***B41J 15/02*** | (2006.01) |
| ***B41J 11/00*** | (2006.01) |
| ***B41J 3/407*** | (2006.01) |

(52) U.S. Cl.

CPC ..... *B41J 15/04* (2013.01); *B41J 3/4075* (2013.01); *B41J 11/0055* (2013.01); *B41J 15/02* (2013.01); *B41J 15/042* (2013.01); *B41J 15/046* (2013.01)

(58) Field of Classification Search

CPC .... B41J 11/0055; B41J 15/046; B41J 15/042; B41J 3/4075; B41J 15/02

USPC ..... 400/633, 633.1, 633.2, 613.1, 88

See application file for complete search history.

(56) References Cited

U.S. PATENT DOCUMENTS

| | | | | |
|---|---|---|---|---|
| 6,068,418 | A * | 5/2000 | Fox | 400/579 |
| 2004/0056143 | A1 * | 3/2004 | Nonomura | 242/596.8 |
| 2006/0158503 | A1 * | 7/2006 | Sodeyama et al. | 347/109 |

FOREIGN PATENT DOCUMENTS

| | | | | |
|---|---|---|---|---|
| CN | 1803461 | A | 7/2006 | |
| EP | 1288006 | A2 * | 3/2003 | B41J 32/00 |
| JP | 11-349197 | A | 12/1999 | |
| JP | 2004058553 | A * | 2/2004 | B41J 2/32 |

* cited by examiner

*Primary Examiner* — Daniel J Colilla

(74) *Attorney, Agent, or Firm* — ALG Intellectual Property, LLC

(57) ABSTRACT

A tape placement apparatus has a roll placement section in which a roll portion Ra of a tape roll is placed in a width direction, a feeding path on which a pulled-out portion Rb of the tape roll is set in the width direction and a set position regulation section that is provided in an outer surface side path formation section forming the feeding path and positionally regulates a width end at an upstream side in a set direction of the pulled-out portion set on the feeding path in the width direction.

5 Claims, 10 Drawing Sheets

TAPE PRINTING APPARATUS WITH SET POSITION REGULATION SECTION

The entire disclosure of Japanese Patent Application No. 2012-076452, filed on Mar. 29, 2012, is expressly incorporated by reference herein.

BACKGROUND

1. Technical Field

The present invention relates to a tape placement apparatus in which a tape roll wound with a tape as fed object is detachably set in a width direction with a state that the tip portion thereof is pulled out, a tape feeding apparatus and a tape printing apparatus.

2. Related Art

In the past, there has been known a tape placement apparatus (printer) in which a tape roll (paper in a roll shape) wound with a tape (paper) as fed object is detachably set in a direction orthogonal to a width direction (for example, see JP-A-11-349197).

In the known tape placement apparatus, it is conceivable to have a structure such that the tape roll is detachably set in a width direction with a state that the tip portion thereof is pulled out. However, in this case, in a feeding path where the pulled-out portion of the tape pulled out from the tape roll is set, there may arise a problem such that the pulled-out portion could be set out-of-position toward an upstream side in a set direction because the set pulled-out portion is not pushed to an appropriate position in the set direction. Since a tape printing apparatus applied with the tape placement apparatus starts printing in the positional misalignment of the pulled-out portion in the set direction, that is, in a tape width direction, a printed character/an image at a printing start portion could be misaligned in the tape width direction.

SUMMARY

An advantage of some aspect of the invention is to provide a tape placement apparatus in which a pulled-out portion set in a feeding path does not misalign toward an upstream side in a set direction when a tape roll wound with a tape as fed object is set in a width direction with a state that the tip portion thereof is pulled out, a tape feeding apparatus and a tape printing apparatus.

In one aspect of the invention, there is provided a tape placement apparatus in which a tape roll wound with a tape as fed object is detachably set in a width direction with a state that a tip portion is pulled out having: a roll placement section in which a roll portion of the tape roll is placed in the width direction; a feeding path on which a pulled-out portion of the tape roll is set in the width direction; and a set position regulation section that is provided in a path formation section forming the feeding path and positionally regulates a width end at an upstream side in a set direction of the pulled-out portion set on the feeding path in the width direction.

According to the structure above, since the set position regulation section which positionally regulates the width end at the upstream side in the set direction of the pulled-out portion set on the feeding path in the width direction thereof, the width end at the upstream side in the set direction of the pulled-out portion set on the feeding path is positionally regulated in the width direction thereof when a user sets the tape roll with the state that the tip portion is pulled out. Therefore, the pulled-out portion set on the feeding path cannot be out-of position toward the upstream side in the set direction.

In this case, it is preferable that the roll placement section be formed in a concave shape, and the tape placement apparatus further have a finger engagement section that is formed in a concave shape continuing to the roll placement section and that is used for taking out the tape roll by pressing an outer surface of a boundary portion between the roll portion and the pulled-out portion, and the set position regulation section be provided on a wall body of the path formation section at a side opposite to an outer surface of the pulled-out portion.

According to the structure above, when the user takes out the tape roll from the tape feeding apparatus, the pulled-out portion moves to the inner surface side thereof, that is, a direction separating from the set position regulation section provided on the wall body of the path formation section at a side opposite to the outer surface of the pulled-out portion. Therefore, when the user takes out the tape roll from the tape feeding apparatus, it is possible to take out the tape roll smoothly because the width end at the upstream side (downstream side in an takeout direction) in the set direction of the pulled-out portion does not abut on the set position regulation section.

In this case, it is preferable that a top surface tip section of the set position regulation section at the upstream side in the set direction of the tape roll be chamfered.

According to the structure above, since the width end at the downstream side in the set direction of the pulled-out portion can be guided on the chamfered surface at the upstream side in the set direction of the pulled-out portion, it is possible to set the tape roll smoothly.

In another aspect of the invention, there is provided a tape feeding apparatus having the tape placement apparatus described above; and a tape feeding section that feeds the tape pulled out from the roll portion placed in the roll placement section along the feeding path, wherein the set position regulation section is disposed on a position facing an imaginary tangent line of an outer circumferential circle of the roll portion passing the tape feeding section, the tape feeding apparatus further has a feeding guide that faces an imaginary straight line connecting a center of the roll portion and the tape feeding section and positionally regulates a width end in the width direction at the upstream side in the set direction of the pulled-out portion.

The tape may be fed in fluctuation due to an adhesion on the tape on an imaginary tangent line of an outer circle of the roll portion passing the tape feeding section and near an imaginary straight line connecting the center of the roll portion and the tape feeding section. In case the tape passes near the imaginary tangent line, feeding of the pulled-out portion is guided by the set position regulation section. On the other hand, in case that the tape passes near the imaginary straight line connecting the center of the roll portion and the tape feeding section, though it is conceivable that the tape deviates from the set position regulation section, the feeding thereof can be guided by the feeding guide by providing the feeding guide which faces the imaginary straight line. In other words, when the tape roll is set, the set position of the pulled-out portion is regulated by the set position regulation section, and when the tape is fed, the feeding can be guided by the set position regulation section and the feeding guide.

In this case, it is preferable that the tape feeding apparatus further have an opening/closing lid that opens/closes the feeding path and on which the feeding guide be provided.

According to the structure above, when the user sets the tape roll in the tape feeding apparatus, the opening/closing lid is opened and the feeding guide separates from the feeding path with the opened lid. Therefore, the feeding guide does not interrupt the setting of the tape roll. Further, after the tape roll is set and the opening/closing lid is closed, the feeding guide faces the imaginary straight line connecting the center of the roll portion and the tape feeding section with the closed lid, and thereby the feeding of the set pulled-out portion can be guided. Thus, it is possible to provide the feeding guide without interrupting the setting of the tape roll.

In the other aspect of the invention, there is provided a tape printing apparatus having the tape feeding apparatus described above and a printing section that prints on the fed tape.

According to the structure above, since the pulled-out portion on the feeding path is not out-of position toward the upstream side in the set direction, it is possible to print properly such that a printed character/an image at a print start portion is not misaligned in the tape width direction.

BRIEF DESCRIPTION OF THE DRAWINGS

The invention will be described with reference to the accompanying drawings, wherein like numbers reference like elements.

FIG. 9A is a view illustrating that the printing tape passes near an imaginary tangent line on an outer circumference circle of a roll portion passing a print feeding portion and FIG. 9B is a view illustrating that the printing tape passes near an imaginary straight line connecting a center of the roll portion and the print feeding portion.

FIGS. 10A and 10B illustrate that the printing tape is ejected before the terminal end thereof passes through the print feeding portion and FIGS. 10C and 10D illustrate that the printing tape is ejected after the terminal end thereof passes through the print feeding portion.

DESCRIPTION OF EXEMPLARY EMBODIMENTS

An embodiment of the invention will be described with reference to the accompanying drawings. In a tape printing apparatus according to the embodiment, a tape roll wound with a printing tape is detachably set in a width direction with a state that the tip portion thereof is pulled out, the set tape is fed to be printed, and a printed portion of the printing tape is cutoff to form a tape segment (label) on which desired printing is performed.

Figure 1:
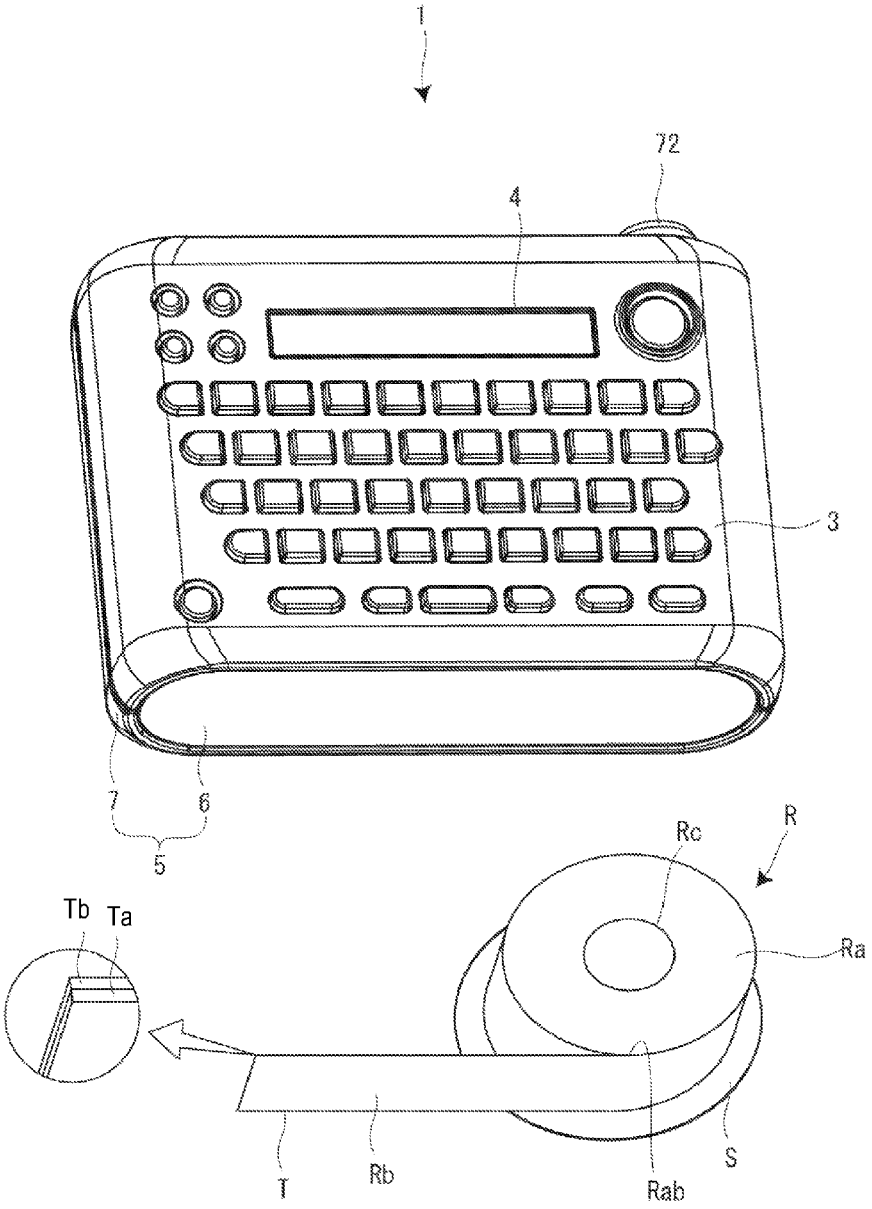
FIG. 1 is an appearance perspective view at atop surface side with a lid closed of a tape printing apparatus according to one embodiment of the invention.
Figure 2:
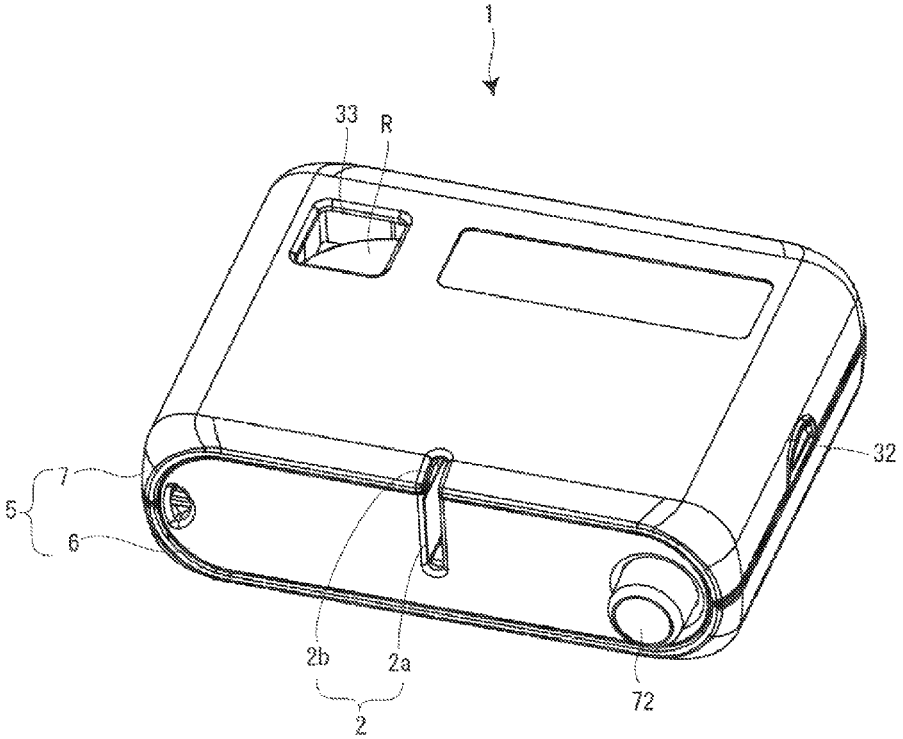
FIG. 2 is an appearance perspective view at a bottom surface side with the lid closed of the tape printing apparatus.
Figure 3:
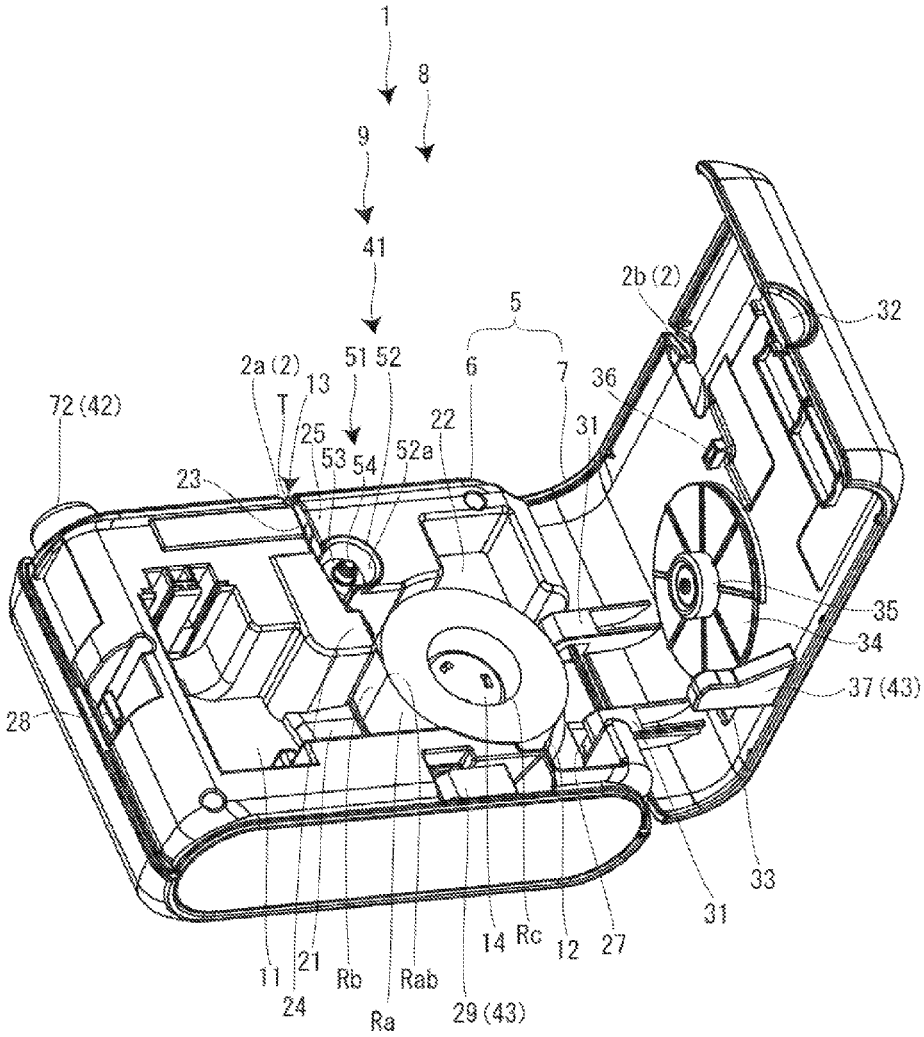
FIG. 3 is an appearance perspective view at the bottom surface side with the lid opened of the tape printing apparatus.
Figure 4:
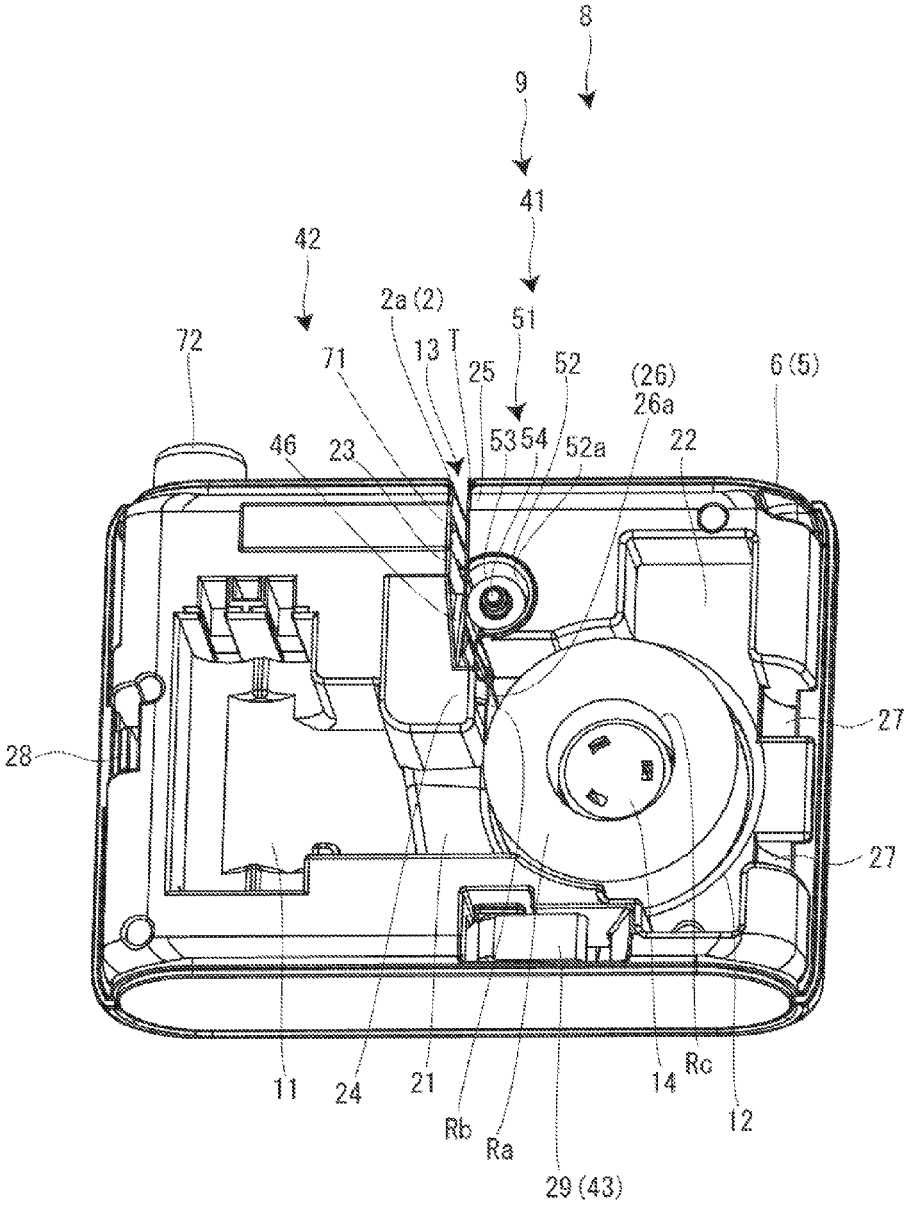
FIG. 4 is an appearance perspective view at the bottom surface side of an apparatus body of the tape printing apparatus.
Figure 5:
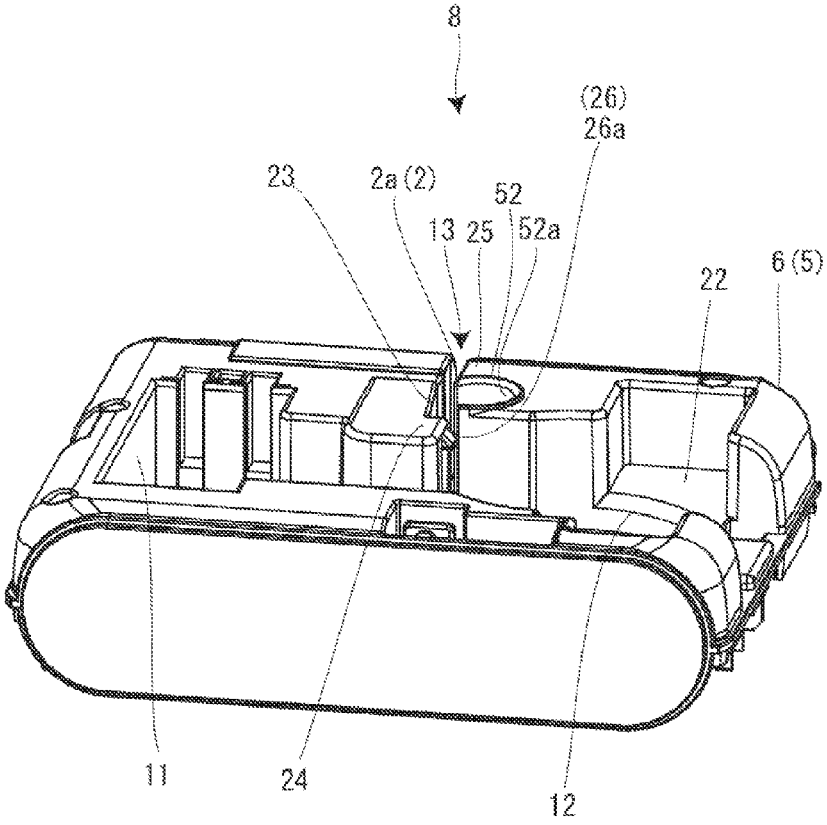
FIG. 5 is an appearance perspective view at the bottom surface side of the apparatus body seen from other angle different from that of FIG. 4.

As illustrated in FIG. 1, a tape roll R set in a tape printing apparatus 1 has a wound printing tape T and a loose prevention seal S which is attached on one side of the printing tape T. Further, the tape roll R does not have a core member as center shaft and is formed such that the printing tape T is simply wound tightly so as to have a circular aperture Rc at the center thereof.

The printing tape T has a recording tape Ta made of thermal paper coated with an adhesive on a rear surface and a release tape Tb adhered on the rear surface of the recording tape Ta, and is wound such that the recording tape Ta faces an outside and the release tape Tb faces an inside. The recording tape Ta is, as it is called, a decorative tape (masking tape) and has various kinds of colors and designs. As applications therefor, it is conceivable that the printing tape T is used for tape segment for handwriting in addition for using as printed tape segment on which thermal printing is performed. The release tape Tb has incisions (not illustrated) in a length direction over the entire length thereof to be easily peeled off by a user.

The loose prevention seal S is annularly formed to correspond to the size of the tape roll R before use (the tape roll R in FIG. 1 indicates a state where the printing tape T is consumed to an extent) and adhered on one side surface of the wound printing tape T. The loose prevention seal S prevents the tape roll R from being loosen.

As illustrated FIGS. 1 to 8, the tape printing apparatus 1 is a handy type and has a configuration representing a camera body as a whole. Shortly, the tape printing apparatus 1 has arc-like cross sections at both side surfaces, has a cylindrical cutter button 72 (described later) on one side at the back surface thereof, and has a tape ejection section 2 at a center in a right-and-left direction from the back surface to a bottom surface. Further, a keyboard 3 is disposed on a top surface of the tape printing apparatus 1 and a landscape-oriented display 4 is provided at a rear of the keyboard 3.

A user inputs/edits information via the keyboard 3 referring to the display 4 and instruct to print via the keyboard 3 so as to print on the printing tape T. After the printing is completed, a printed tape segment can be acquired by pressing the cutter button 72 by the user. Further, after a predetermined feeding amount of the printing tape T is instructed through the keyboard 3 and a feeding is completed, a tape segment for handwriting can be acquired by pressing the cutter button 72 by the user.

An outer shell of the tape printing apparatus 1 having such an appearance is formed by an apparatus case 5. The apparatus case 5 has a main body case 6 constituting an apparatus main body 8 having a structure apparatus 9 therein and an opening/closing lid 7 (lid case) as bottom lid which is opened/closed freely provided on a bottom surface side of the apparatus main body 8. At the bottom surface side of the apparatus main body 8 where the opening/closing lid 7 is opened, a battery accommodation section 11 in which a battery is accommodated is formed in a concave shape at one half portion in the right- and left direction and a roll placement section 12 where a roll portion Ra of the tape roll R is placed in the width direction is formed in a concave shape at the other half portion. Further a feeding path 13 used for feeding to pull out the tape roll R is formed between the roll placement section 12 and the tape ejection section 2, and a pulled-out portion Rb of the tape roll R is set in the width direction on the feeding path 13. In other words, the user places the roll portion Ra in the width direction in the roll placement section 12 from the apparatus bottom surface side and sets the pulled-out portion Rb in the width direction on the feeding path 13 from the apparatus bottom surface side so as to form a state in which the tip portion is out of the apparatus via the tape ejection section 2.

The roll placement section 12 opens to the apparatus bottom surface side and has a bottom surface which is formed as shallow circular groove. A cylindrical guide boss 14 fixedly projects at the center of the bottom surface. The guide boss 14 holds the roll portion Ra of the tape roll R detachably and pulling out freely together with a rotation disk 34 described later of the opening/closing lid 7. The user opens the opening/closing lid 7, sets the loose prevention seal S oriented to the bottom side, engages the circular aperture Rc of the roll portion Ra loosely on the guide boss 14 and puts the roll portion Ra on the roll placement section 12.

Further, a first finger engagement section 21 provided between the roll placement section 12 and the battery accommodation section 11 and continued to them at each end, and a second finger engagement section 22 provided at the back of the roll placement section 12 and continued to the roll placement section 12 are formed in a concave shape, respectively. The user presses an outer surface (recording tape Ta side) near a boundary portion Rab between the roll portion Ra and the pulled-out portion Rb by a finger I the first finger engagement section 21 and presses an outer surface of the roll portion Ra by another finger in the second finger engagement section 22, which enables the user to take out the tape roll R in the width direction such that the roll portion Ra placed in the roll placement section 12 is picked up to pinch approximately in a radial direction.

The feeding path 13 has a groove shape deeper than a width of the printing tape T, which is, the groove shape where a bottom surface side opens deeply in an apparatus top-and-bottom direction. A width end of the opened bottom surface side is a set section 23 where the pulled-out portion Rb of the tape roll R is set from one width end in the width direction. The printing tape T set on the feeding path 13 is fed in a vertical orientation in the width direction as the apparatus top-and-bottom direction.

The feeding path 13 is formed with an outer surface side path formation section 24 facing the outer surface (recording tape Ta) of the set pulled-out portion Rb and an inner surface side path formation section 25 facing the inner surface (release tape T) of the set pulled-out portion Rb. A side wall of the outer surface side path formation section 24 is mainly formed by the main body case 6. An outer edge of the side wall is formed in a crank shape which bends toward an outer surface side of the pulled-out portion Rb seen from an upstream side in a feeding direction. At a downstream side in the feeding direction under the bending portion, a print head 46 and a tape cutter 71 described later are disposed. While, a side wall of the inner surface side path formation section 25 is mainly formed by the main body case 6 in a similar manner, the outer edge thereof is formed as a shape which bends approximately at an right angle at a position approximately facing the bending portion of the outer surface side path formation section 24 and a platen 51 described later is disposed at the bending portion.

The feeding path 13 thus formed by the outer surface side path formation section 24 and the inner surface side path formation section 25 is formed in a crank shape which bends toward the outer surface side of the set pulled-out portion Rb seen from the upstream side in the feeding direction. This allows the pulled-out portion Rb to maintain the bended state and avoids that the tip portion of the pulled-out portion Rb out of the apparatus from the tape ejection section 2 is pulled in the apparatus by external force.

Further, at an upstream end portion (near the roll placement section 12) of the feeding path 13, a set position regulation section 26 is projected on the side wall of the outer surface side path formation section 24. The set position regulation section 26 regulates the width end at an upstream side (apparatus bottom surface side) in the set direction of the pulled-out portion Rb set on the feeding path 13 in the width direction thereof. Though a detail is described later, the set position regulation section 26 faces on an imaginary tangent line 81 (see FIG. 9A) of an outer circumference circle of the roll portion Ra (loose prevention seal S) passing a print feeding section 41.

Figure 6:
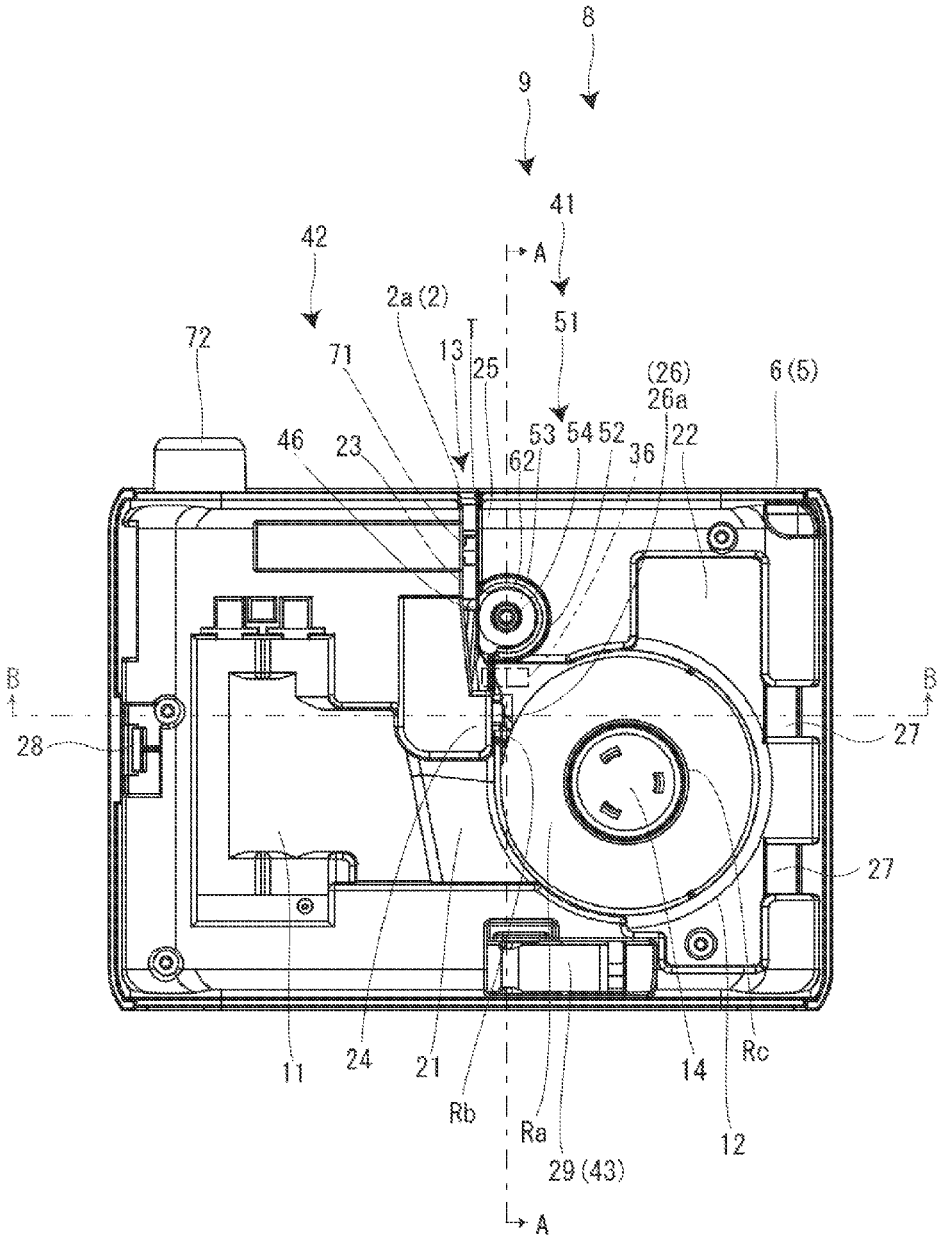
FIG. 6 is a plan view of the apparatus body of the tape printing apparatus seen from the bottom.
Figure 8:
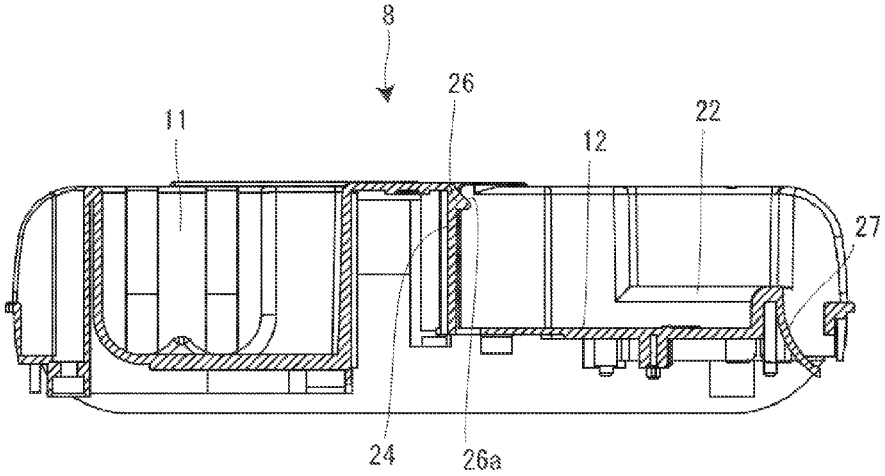
FIG. 8 is a cross sectional view of the apparatus body cut out along a B-B line in FIG. 6.

FIG. 8 is a cross sectional view of the tape printing apparatus 1 in a lid opening state cutout along a B-B line in FIG. 6. A top surface tip section at the upstream side (apparatus bottom surface side) in the set direction of the set position regulation section 26 is chamfered. In other words, a top surface (regulation section top surface 26*a*) at the apparatus bottom surface side of the set position regulation section 26 is a decline from a base section toward the tip section.

The provision of the set position regulation section 26 allows the width end at the upstream side (apparatus bottom surface side) in the set direction of the pulled-out portion Rb set on the feeding path 13 to be positionally regulated in the width direction thereof when the user sets the tape roll R in the width direction with the state that the tip portion is pulled out. Therefore, the pulled-out portion Rb set on the feeding path 13 is not out of alignment toward the upstream side in the set direction. Specifically, when the pulled-out portion Rb is set on the feeding path 13, the pulled-out portion Rb is not away from the feeding path 13.

Then, when the opening/closing lid 7 is closed in the set state, the pulled-out portion Rb is held between the print head 46 and the platen 51 without being out of alignment and printing is started in the tape width direction without the positional misalignment. As to the positional regulation on the width end at the downstream side (apparatus top surface side) in the set direction, the roll portion Ra is positionally regulated by the bottom surface of the roll placement section 12 and the pulled-out portion Rb is positionally regulated by a groove bottom of the feeding path 13.

Further, since the top surface tip portion at the apparatus bottom surface side of the set position regulation section 26 is chamfered, it is possible to guide the width end at the downstream side in the set direction of the pulled-out portion Rb to the declined regulation section top surface 26*a* when the user sets the tape roll R in the tape printing apparatus 1. Therefore, it is possible to set the tape roll R smoothly without disturbance of the set position regulation section 26 projected on the side wall of the outer surface side path formation section 24.

Further, in case that the user takes out the tape roll R from the tape printing apparatus 1 for changing tape rolls R having other color/design, when the outer surface near the boundary portion Rab between the roll portion Ra and the pulled-out portion Rb is pressed by the finger on the first finger engagement section 21 described above, the pulled-out portion Rb moves toward its' inner surface side, that is, toward a direction separating from the set position regulation section 26 projected on the side wall of the outer surface side path formation section 24 facing the outer surface of the pulled-out portion Rb. Therefore, when the user takes out the tape roll R from the tape printing apparatus 1, the tape roll R can be taken out smoothly such that the width end at the upstream side (apparatus bottom surface side) in the set direction of the pulled-out portion Rb does not engage with the bottom surface (apparatus top surface side) of the set position regulation section 26.

A main body side ejection section 2*a* is formed at a downstream end position of the set section 23 on a center of the back surface of the main body case 6. The main body side ejection section 2*a* corresponds to a downstream end of the feeding path 13 and is formed in an elongated "U"-shape seen from the back of the apparatus. The opening edge thereof is chamfered. The main body side ejection section 2*a* and a lid side ejection section 2*b* described later form the tape ejection section 2.

Besides, the main body case 6 is formed with a pair of latch sections 27 on one side end section which form a hinge with a pair of hinge pieces 31 provided on the opening/closing lid 7 described later, and is formed with a pawl piece 28 on the other side end section which forms a closure mechanism with a closure section 32 provided on the opening/closing lid 7. Further, an engagement block 29 on which an operation projection 37 provided on the opening/closing lid 7 engages/disengages is rotatably supported on the main body case 6 at a front of the roll placement section 12.

The opening/closing lid 7 covers the whole bottom surface of the apparatus main body 8, and has the pair of hinge pieces 31 on one side end section forming the hinge with the pair of latch sections 27 provided on the main body case 6 and the closure section 32 on the other side end section which forms the closure mechanism with the pawl piece 28 provided on the main body case 6. The pair of hinge pieces 31 has a configuration of engagement pawls and are formed to be rotatable with respect to the pair of latch sections 27 of the main body case 6 and to be engaged/disengaged freely with a state that the opening/closing lid 7 is opened. Further, the pawl piece 28 of the main body case 6 has spring character and is formed capable of locking/unlocking the closure section 32. In case of closing the opening/closing lid 7, the pair of hinge pieces 31 are latched with the pair of latch sections 27, the opening/closing lid 7 is rotated in a closing direction centered around the pair of latch sections 27, and the closure section 32 is locked on the pawl piece 28. On the other hand, in case of opening the opening/closing lid 7, the lock between the closure section 32 and the pawl piece 28 is released by rotating the opening/closing lid 7 in an opening direction, the opening/closing lid 7 is rotated in the opening direction centered around the pair of latch sections 27. Further, the opening/closing lid 7 in the opened state may be detached from the main body case 6 as needed.

Further, in the opening/closing lid 7, a transparent small window 33 is formed at a position corresponding to the roll portion Ra set in the roll placement section 12 and a remaining amount of the tape roll R, a color/a design and the like of the printing tape T can be checked through the small window 33. Further, the rotation disk 34 with an axis projection 35 is rotatably attached on an inner side of the opening/closing lid 7, and a feeding guide 36 described later and the operation projection 37 are projected around the rotation disk 34.

When the user sets the loose prevention seal S at the bottom, engages the circular aperture Rc with the guide projection 14 loosely, places the roll portion Ra in the roll placement section 12 and closes the opening/closing lid 7 described above, the axis projection 35 fits in the circular aperture Rc from above and an end surface which is not adhered with the loose prevention seal S abuts on the rotation disk 34 to set the tape roll R.

After the user has set the tape roll R, the user usually turns over the tape printing apparatus 1, in other words, sets the top surface side of the tape printing apparatus 1 to be oriented above to input/edit and to perform a printing process via the keyboard 3. Therefore, the set tape roll R is substantially maintained on the rotation disk 34 provided rotatably on the opening/closing lid 7. This allows the printing tape T to be pulled out smoothly in a printing operation and the like.

The feeding guide 36 is projected in a small rectangular flame shape at an approximately center portion inside the opening/closing lid 7. When the opening/closing lid 7 is closed, the feeding guide 36 faces the feeding path 13 from above (apparatus bottom surface side) (see FIG. 6). Though a detail is described later, the feeding guide 36 faces an imaginary straight line 82 connecting the center of the roll portion Ra set in the roll placement section 12 and the print feeding section 41 (see FIG. 9B).

Further, at the center of the back end section of the opening/closing lid 7, the lid side ejection section 2*b* is formed in notch which coincides with the above main body side ejection section 2*a* and is located at the apparatus bottom surface side of the above set section 23 in the closure state. The lid side ejection section 2*b* is formed in an approximate "U"-shape seen from the apparatus bottom surface side and the opening edge thereof is chamfered. The lid side ejection section 2*b* together with the main body side ejection section 2*a* forms the tape ejection section 2. In other words, the tape ejection section 2 has the main body side ejection section 2*a* opening to the apparatus back surface and the lid side ejection section 2*b* opening to the apparatus bottom surface. As a whole, the tape ejection section 2 is formed in a slit shape which opens from the apparatus back surface to the bottom surface and has a width corresponding to the thickness of the printing tape T. The tape ejection section 2 can eject the fed printing tape T forward (apparatus backward direction) in the feeding direction and can eject the printing tape T as tape end downward.

The structure apparatus 9 has the print feeding section 41 which feeds the printing tape T to print thereon, a cut section 42 which is provided in the forward direction (downstream side) in the feeding direction of the print feeding section 41 and cuts the back end of the printed portion of the printing tape T, and a lid interlocking mechanism 43 which cooperates with opening/closing of the opening/closing lid 7 to rotate the printing head 46 of the print feeding section 41.

The print feeding section 41 has the printing head 46 formed by a thermal head, the platen 51 facing the printing head 46 having the printing tape T (the pulled-out portion Rb) therebetween, and a roller accommodation section 52 which accommodates a platen roller 53 (described later) of the platen 51. The printing head 46 is rotatably supported by a rotation axis (not illustrated). This enables the printing head 46 to be rotatably constructed between a printing position and a non-printing position.

Figure 7:
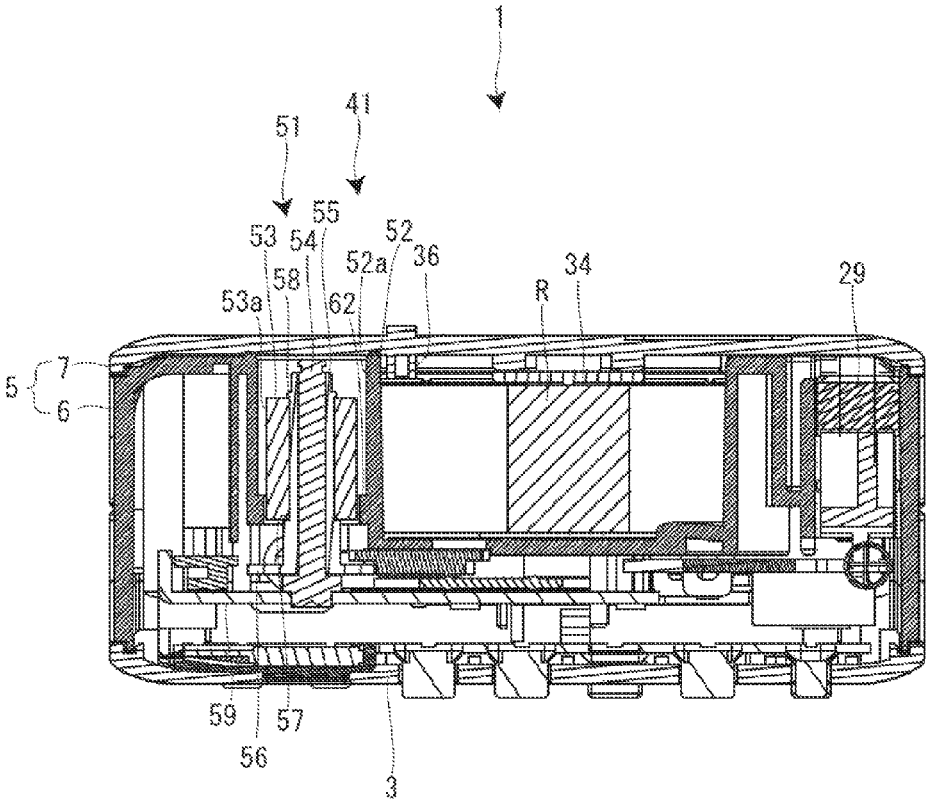
FIG. 7 is a cross sectional view of the tape printing apparatus with the lid closed, which is cut out along an A-A line in FIG. 6.

FIG. 7 is a cross sectional view of the tape printing apparatus 1 with a state of lid closed, which is cutout along an A-A line in FIG. 6 (FIG. 6 illustrates only the apparatus main body 8, while FIG. 7 illustrates with the opening/closing lid 7). As illustrated in FIG. 7, the platen 51 has the cylindrical platen roller 53 (feeding roller) which rotationally contacts to feed the printing tape T, a roller shaft 54 which rotatably supports the platen roller 53 in a cantilever state, and a gear formation member 55 which is installed between the roller shaft 54 and the platen roller 53.

The roller shaft 54 is supported in a cantilever state by an apparatus frame 59 at an end section of the apparatus top surface side (lower side in the figure), and the platen roller 53 is supported in the cantilever state via the roller shaft 54 at the end section of the apparatus top surface side. Shortly, an axis direction of the platen roller 53 is set as the apparatus top-and-bottom direction. In case that the tape printing apparatus 1 is disposed with the top side thereof facing above (at the time of normal print feeding), the printing tape T is fed in a horizontal direction and toward the tape ejection section 2 provided at the back of the apparatus in the vertical orientation where the width direction thereof is set in the top-and-bottom direction. Further, the length of the platen roller 53 in the axial direction is somewhat shorter than the width of the printing tape T, and the printing tape T is fed at a center where the center position of the platen roller 53 in the axial direction is aligned with the center position of the printing tape in the width direction.

The gear formation member 55 is formed in an approximately cylindrical shape on which a flange-like gear section 56 is formed at the end section thereof, and covers approximately allover the roller shaft 54. In short, the roller shaft 54 penetrates the gear formation member 55 in the axial direction such that the gear section 56 is positioned at a base end side (apparatus top surface side) of the roller shaft 54 and is rotatably supported by the roller shaft 54. Further, at an outer circumferential surface of the gear formation member 55, an outer surface annular convex section 58 is formed at an end section (apparatus bottom surface side) opposite to the gear section 56 and an outer surface annular step section 57 is formed near the gear section 56. The platen roller 53 fits between the outer surface annular convex section 58 and the outer surface annular step section 57. Then, when the gear formation member 55 is rotated by inputting rotational power from a power section (not illustrated) to the gear section 56, the platen roller 53 fit in the gear formation member 55 also rotates. In other words, the platen roller 53 is rotatably supported by the roller shaft 54 via the gear formation member 55.

The roller accommodation section 52 is formed by the main body case 6, has a roller opening aperture 61 (see FIGS. 9A and 9B) which faces the accommodated platen roller 53 to the printing tape T and a cylindrical accommodation section inner surface 52*a* which has the same shape with a roller outer circumferential surface 53*a* of the platen roller 53, and accommodates the platen roller 53 having a gap between the accommodation section inner surface 52*a* and the roller outer circumferential surface 53*a*. The roller outer circumferential surface 53*a* of the platen roller 53 accommodated in the roller accommodation section 52 slightly projects from the roller opening aperture 61 toward the printing head 46 side and contacts to rotate the pulled-out portion Rb of the tape roll R set on the feeding path 13. The platen roller 53 accommodated in the roller accommodation section 52 is supported in the cantilever state at one end section side (apparatus top surface side) in the axial direction and opens at the other end section side (apparatus bottom surface side).

Further, a cutout annular step section 62 is formed at a portion corresponding to the end section of the apparatus top surface side of the accommodated platen roller 53 on the accommodation section inner surface 52*a* of the roller accommodation section 52. The cutout annular step section 62 forms a minute gap with which a gap between the accommodation section inner surface 52*a* and the roller outer circumferential surface 53*a* is minimal at the end section of the apparatus top surface side of the platen roller 53.

Thus, the roller accommodation section 52 which accommodates the platen roller 53 having the gap between the accommodation section inner surface 52*a* and the roller outer circumferential surface 53*a* is provided. Therefore, even if the platen roller 53 rolls up the printing tape T due to an adhesion on the rear surface of the printing tape T and the wound printing tape T fills in the minute gap between the accommodation section inner surface 52*a* at the end section of the apparatus top surface side of the platen roller 53 and the roller outer circumferential surface 53*a* (for example, an amount of two rotations of the platen roller 53), the printing tape T is not wound on the platen roller 53 anymore. Thus, it is possible to prevent the printing tape T in large quantity from winding on the platen roller 53. At this time, a gap in which an amount up to six rotations of the platen roller 53 fills is provided at a portion other than the end section at the apparatus top surface side of the platen roller 53, and a gap corresponding to a difference between the minute gap remains (four rotations of the platen roller 53). Therefore, the printing tape T wound on the platen roller 53 is in a state to be kept between the accommodation section inner surface 52*a* and the roller outer circumferential surface 53*a* only at the end section at the apparatus top side of the platen roller 53.

Since the end section at the apparatus bottom surface side of the platen roller 53 opens, the user can easily pull out the printing tape T wound on the platen roller 53 in the tape width direction from the end section at the apparatus bottom surface side of the opened platen roller 53 so as to be guided between the accommodation section inner surface 52*a* and the roller outer circumferential surface 53*a*. At this time, as described above, since the printing tape T wound on the platen roller 53 is in the state to be kept between the accommodation section inner surface 52*a* and the roller outer circumferential surface 53*a* only at the end section at the apparatus top surface side of the platen roller 53, friction force between the printing tape T and the accommodation section inner surface 52*a* or the roller outer circumferential surface 53*a* is little when the printing tape T is pulled out, and moreover, it is possible to pull out with little resistance when the kept portion is pulled out. Thus, it is possible not to wind the printing tape T in large quantity on the platen roller 53 and to easily get rid of the printing tape T wound on the platen roller.

In the embodiment, the minute gap is formed between the roller outer circumferential surface 53*a* by the cutout annular step section 62 formed on the accommodation section inner surface 52*a*, but the minute gap can be formed by other structure. For example, the minute gap may be formed by the accommodation section inner surface 52*a* which is formed in a tapered shape to have a smaller diameter toward the end section at the apparatus top surface side of the platen roller 53. Though, it is possible to have the maximum difference between the minute gap at any portion other than the end section at the apparatus top surface side of the platen roller 53 by providing the cutout annular step section 62 as the embodiment. A plurality of step sections may be separately disposed in a circumferential direction in place of the cutout annular step section 62.

In the print feeding section 41 structured above, when in printing, the platen 51 rotates to hold the printing tape T with the printing head 46 rotated at the printing position and pulls out to feed the printing tape T forward. While, the printing head 46 is thermally driven in synchronization with the feeding of the printing tape T by the platen 51. Thus, desirable printing is performed on the printing tape T being ejected from the tape ejection section 2 in the feeding direction and is fed until the back end of the printed portion faces the tape cutter 71 of the cut section 42. In case of acquiring tape segments for handwriting, the printing head 46 is not thermally driven (idling printing).

The cut section 42 has the tape cutter 71 which cuts the printing tape T, the cutter button 72 which makes the tape cutter 71 perform cutting action by a manual operation, and a cutting force transmission section (not illustrated) which transforms power from a pressed button action of the cutter button 72 to a sliding action of the tape cutter 71.

The lid interlocking mechanism 43 has the operation projection 37 provided on the opening/closing lid 7, the engagement block 29 which rotates by engaging/disengaging with the operation projection 37 in accompanying with opening/closing of the opening/closing lid 7, and a release lever (not illustrated) which rotates by rotation of the engagement block 29, and the printing head 46 is connected to a tip section of the release lever. In state that the opening/closing lid 7 is closed, the operation projection 37 engages with the engagement block 29, the release lever moves to one rotation end position, and the printing head 46 moves to the printing position. At this moment, the pulled-out portion Rb set on the feeding path 13 is held between the printing head 46 and the platen roller 53 to be capable of print feeding. When the opening/closing lid 7 is opened from this state, the operation projection 37 disengages with the engagement block 29, the release lever move to the other rotation end position and the printing head 46 moves to the non-printing position. Thus, the held state of the pulled-out portion Rb is released and the pulled-out portion Rb can be detachable.

Though not illustrated, the release lever retains a lock section which engages/disengages with a gear constituting the above cutting force transmission section. When the opening/closing lid 7 is opened and the release lever moves to the other rotation end position, the lock section retained by the release lever engages with the gear of the cutting force transmission section to lock activation of the cutting force transmission section. With the action above, the cutter button 72 cannot be pressed in the opening state of the opening/closing lid 7 and the tape cutter 71 cannot perform the cutting action. In other words, the lid interlocking mechanism 43 interlocks with the opening/closing of the opening/closing lid 7 to move the printing head 46 between the printing position and the non-printing position and locks/unlocks the action of the tape cutter 71.

Figure 9A:
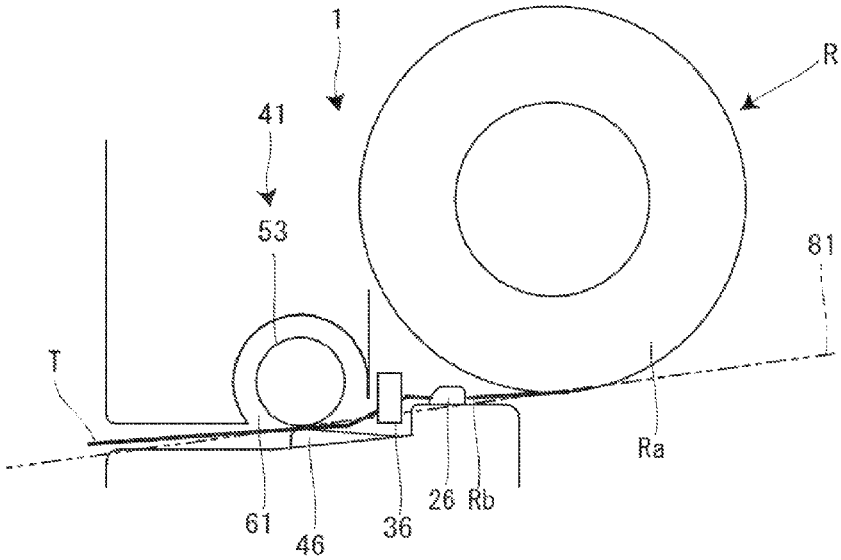
FIGS. 9A and 9B are schematic views of a path on which a printing tape is fed in the tape printing apparatus, where
Figure 9B:
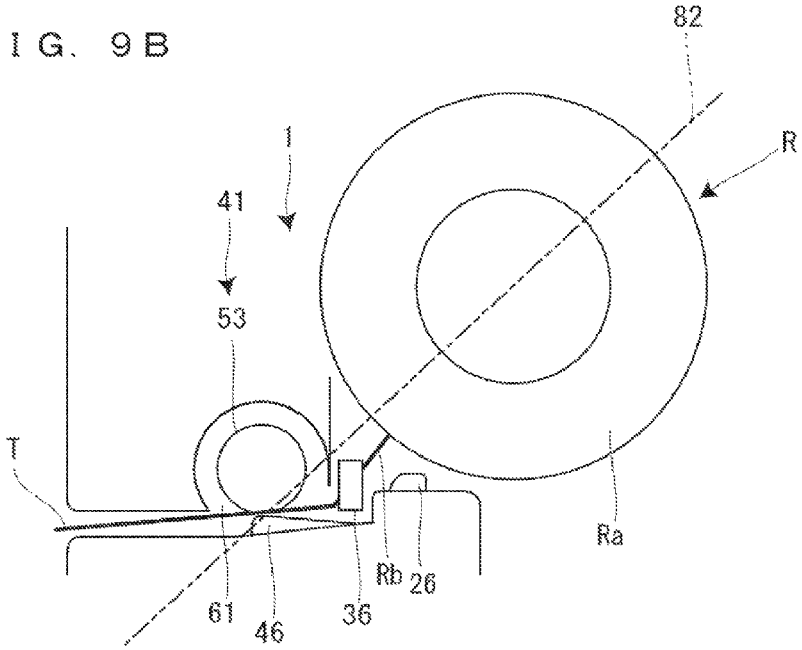

Referring to FIGS. 9A and 9B, a path on which the printing tape T is fed in the tape printing apparatus 1 will be explained. The printing tape T is fed in fluctuation between on the imaginary tangent line 81 of the outer circumferential circle of the roll portion Ra passing the print feeding section 41 and on the imaginary straight line 82 connecting the center of the roll portion Ra and the print feeding section 41 described above depending on strength of the adhesion force between a side surface at the back end portion of the pulled-out portion Rb and the loose prevention seal S. In case that the printing tape T passes near the imaginary tangent line 81, the feeding of the printing tape T is guided by the set position regulation section 26 and the feeding guide 36 (see FIG. 9A).

On the other hand, in case that the printing tape T passes near the imaginary straight line 82, the printing tape T may deviate from the set position regulation section 26. In this case, the feeding can be guided by the feeding guide 36 (see FIG. 9B). Accordingly, at the time of setting the tape roll R, the set position of the pulled-out portion Rb can be regulated by the set position regulation section 26, and at the time of feeding the printing tape T, the feeding of the printing tape T can be guided by the set position regulation section 26 and the feeding guide 36. At the time of setting the tape roll R, when the opening/closing lid 7 is closed, the pulled-out portion Rb is held between the printing head 46 and the platen roller 53 by the lid interlocking mechanism 43 before the feeding guide 36 abuts on the width end at the upstream side in the set direction of the pulled-out portion Rb.

Moreover, since the feeding guide 36 is provided on the opening/closing lid 7, the feeding guide 36 separates from the feeding path 13 when the opening/closing lid 7 is opened by the user for setting the tape roll R in the tape printing apparatus 1. Therefore, the feeding guide 36 does not interrupt the setting of the tape roll R.

In the tape printing apparatus 1, the printing tape T fed by the print feeding section 41 is ejected forward (backward of the apparatus) in the feeding direction from the tape ejection section 2, and the printing tape T of which a terminal end (winding start end of the tape roll R) passes the print feeding section 41 because a tape remaining amount of the tape roll R is little (tape end) is ejected downward (apparatus bottom surface side). This process will be described below.

Figure 10A:
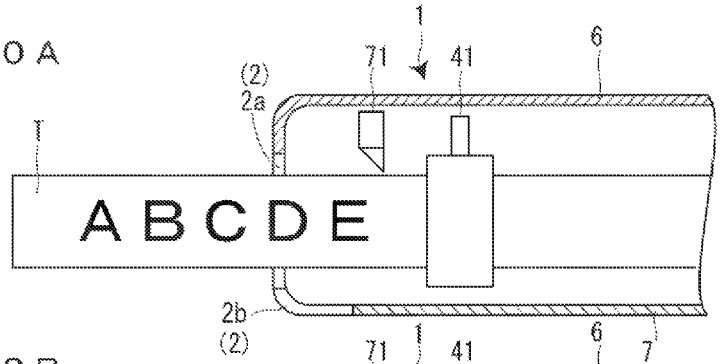
FIGS. 10A and 10D are schematic views illustrating that the printing tape is ejected from a tape ejection section in the tape printing apparatus, where
Figure 10B:
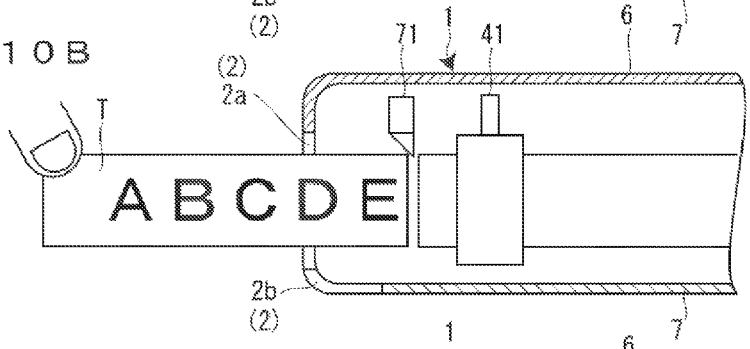

As illustrated in FIGS. 10A to 10D, the tip portion of the printing tape T before the terminal end thereof passes the print feeding section 41 is ejected forward (backward of the apparatus) in the feeding direction from the tape ejection section 2 with the state that the printing tape T is held by the print feeding section 41 (the printing head 46 and the platen roller 53), and the back end of the printed portion is fed to backward of the apparatus to a position facing the tape cutter 71 (see FIG. 10A). Then, when the user presses the cutter button 72 and the tape cutter 71 cuts the back end of the printed portion, the user pinches the tip portion of the printing tape T (tape segment) projected outside the apparatus from the tape ejection section 2 to pull out the printing tape T from the tape ejection section 2, and thereby the printing tape T can be taken out outside the apparatus (see FIG. 10B).

Figure 10C:
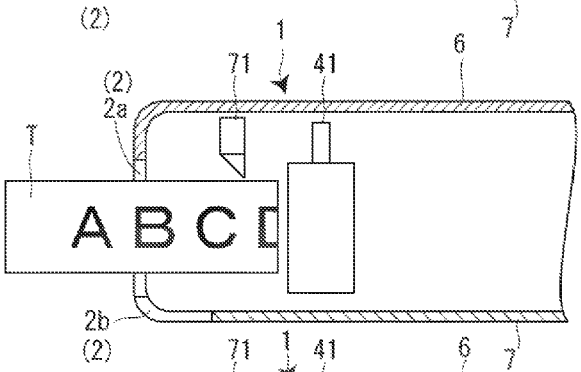
Figure 10D:
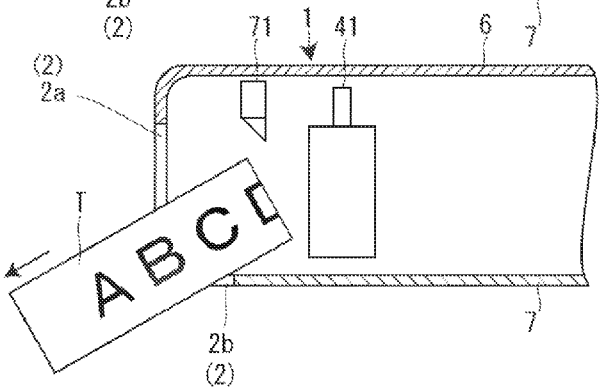

While, the printing tape T after the terminal end thereof passes through the print feeding section 41 is in a state that holding by the print feeding section 41 is released because the terminal end thereof passes through the print feeding section 41 (see FIG. 10C). At this moment, the print feeding section 41 is in an idling state and the printing tape T cannot be fed forward anymore. At this moment, if an intermediate portion of the printed portion of the printing tape T is cut by the tape cutter 71, a tape segment at the terminal end side with respect to the cut portion remains in the apparatus (between the tape cutter 71 and the print feeding section 41) and it is difficult for the user to take it out outside the apparatus. However, since the printing tape T is not actually held by the print feeding section 41, the width end of the printing tape T abut on the opening/closing lid 7 at the bottom surface side (down side) through the set section 23 due to the weight thereof as soon as the terminal end passes through the print feeding section 41, that is, before the tape cutter 71 cuts. Further, the printing tape T rotates downward around the end portion at the upstream side end portion in the feeding direction of the tape ejection section 2 (the lid side ejection section 2*b*) as pivot point to be slidingly ejected downward from the tape ejection section 2 (see FIG. 10D). Therefore, the terminal end portion of the printing tape T cannot be remained in the apparatus.

The tape printing apparatus 1 of the embodiment feeds the printing tape T in the vertical orientation with the width direction set as the top-and-bottom direction, the tape ejection section 2 is formed in a slit shape having the width corresponding to the thickness of the printing tape T, and the printing tape T is ejected downward through the tape ejection section 2 with one width end of the printing tape T oriented to the bottom. However, the printing tape T may be fed in a lateral orientation with the width direction of the printing tape T horizontally and the tape ejection section 2 may be formed in a rectangular shape having the width corresponding to the tape width and the downside thereof being opened. Also in this case, the terminal end portion of the printing tape T can be ejected downward through the tape ejection section 2 with the front surface or the rear surface of the printing tape T oriented to the bottom. Of course, in the embodiment, it is possible to make the aperture area of the tape ejection section 2 small by forming the tape ejection section 2 as a slit shape having the width corresponding to the thickness of the printing tape T, and is possible to avoid inserting a finger and so forth by mistake in the tape ejection section 2 from outside the apparatus and mixing of foreign substances therein.

As described above, according to the tape printing apparatus 1 of the embodiment, the terminal end portion of the printing tape T cannot stay in the apparatus by providing the tape ejection section 2 which allows the printing tape T of which the terminal end passes through the print feeding section 41 to be ejected downward. Further, the pulled-out portion Rb set on the feeding path 13 cannot be out-of-position toward the upstream side in the set direction by providing the set position regulation section 26 when the tape roll R wound with the printing tape T is set in the width direction with the tip portion thereof is pulled out. Still further, the printing tape T in large quantity cannot be wound on the platen roller 53 and the printing tape T wound on the platen roller 53 can be easily taken out by rotatably supporting the platen roller 53 at one end section side in the cantilever state and by opening at the other end section side.

What is claimed is:

1. A tape printing apparatus in which a tape roll wound with a tape as fed object is detachably set in a width direction with a state that a tip portion is pulled out comprising:

a roll placement section, which is formed in a concave shape, in which a roll portion of the tape roll is placed in the width direction;

a feeding path on which a pulled-out portion of the tape roll is set in the width direction, the feeding path having a groove bottom that positionally regulates a width end at one side in a set direction of the pulled-out portion;

a set position regulation section that is provided in a path formation section forming a part of the feeding path and positionally regulates a width end at the other side in the set direction of the pulled-out portion set on the feeding path in the width direction;

a tape feeding section that feeds the pulled-out portion of the tape roll from the roll portion of the tape roll placed in the roll placement section along the feeding path;

a printing section that prints on the pulled-out portion of the tape roll; and two finger engagement sections which are formed in a concave shape continuous with the roll placement section;

wherein the two finger engagement sections consist of a first finger engagement section and a second finger engagement section, and the first finger engagement section is used for pressing an outer surface of the tape roll at a boundary of the roll portion and the pulled-out portion in case of taking out the tape roll, and the first finger engagement section and the second finger engagement section are spaces respectively independent from each other when the roll portion of the tape roll is placed in the roll placement section, and the set position regulation section is provided on a wall body of the path formation section at a side opposite to an outer surface of the pulled-out portion continuous with an outer surface of the roll portion.

2. The tape printing apparatus according to claim 1, wherein the first finger engagement section is formed in a concave shape continuous with the roll placement section.

3. The tape printing apparatus according to claim 1, wherein a top surface tip section of the set position regulation section at the other side in the set direction of the tape roll is chamfered.

4. The tape printing apparatus according to claim 1, wherein:

the set position regulation section is disposed on a position facing an imaginary tangent line of an outer circumferential circle of the roll portion passing the tape feeding section, and the tape printing apparatus further comprises a feeding guide that faces an imaginary straight line connecting a center of the roll portion and the tape feeding section and positionally regulates a width end in the width direction at the other side in the set direction of the pulled-out portion.

5. The tape printing apparatus according to claim 4, further comprising a lid that opens and closes the feeding path and on which the feeding guide is provided.

* * * * *